US006584704B2

(12) United States Patent
March

(10) Patent No.: US 6,584,704 B2
(45) Date of Patent: Jul. 1, 2003

(54) DISPOSABLE SHOE COVER

(76) Inventor: Susan March, 465 Broadway Ave., Bedford, OH (US) 44146

( * ) Notice: Subject to any disclaimer, the term of this patent is extended or adjusted under 35 U.S.C. 154(b) by 0 days.

(21) Appl. No.: 09/735,105

(22) Filed: Dec. 12, 2000

(65) Prior Publication Data

US 2002/0069553 A1 Jun. 13, 2002

(51) Int. Cl.[7] ..... A43B 3/16; A43B 5/08
(52) U.S. Cl. ..... 36/7.1 R; 36/7.3; 36/72 R
(58) Field of Search ..... 36/7.3, 7.1 R, 36/7.2, 7.4, 1.5, 96, 133, 72 R, 8.1, 73

(56) References Cited

U.S. PATENT DOCUMENTS

| | | | | | |
|---|---|---|---|---|---|
| 1,603,923 | A | | 10/1926 | Powers | |
| 1,854,969 | A | | 4/1932 | Walsh | |
| 2,171,654 | A | | 9/1939 | Hinchliff | |
| 2,479,006 | A | * | 8/1949 | Garth | 36/7.3 |
| 3,084,459 | A | * | 4/1963 | Colman | 36/7.1 R |
| 3,141,247 | A | * | 7/1964 | Mackay | 36/7.1 R |
| 3,221,421 | A | * | 12/1965 | Liebmann et al. | 36/7.1 R |
| 3,605,291 | A | | 9/1971 | Moore et al. | |
| 3,634,954 | A | * | 1/1972 | Larsen et al. | 36/7.3 |
| 4,043,326 | A | | 8/1977 | Little et al. | |
| 4,083,124 | A | * | 4/1978 | Michalak | 36/7.1 R |
| 4,967,491 | A | * | 11/1990 | Plotkin | 36/7.1 R |
| 5,144,759 | A | * | 9/1992 | Mascotte | 36/7.1 R |
| 5,222,313 | A | * | 6/1993 | Dowdy et al. | 36/8.1 |
| 5,396,717 | A | * | 3/1995 | Bell | 36/7.3 |
| 5,544,430 | A | * | 8/1996 | Jacko | 36/7.1 R |
| 5,845,416 | A | * | 12/1998 | Hands | 36/7.2 |
| 5,890,302 | A | * | 4/1999 | Kirkis | 36/7.1 R |
| 6,038,792 | A | * | 3/2000 | Hauter | 36/7.1 R |

* cited by examiner

*Primary Examiner*—Anthony D. Stashick
(74) *Attorney, Agent, or Firm*—Renner, Otto, Boisselle & Sklar, LLP

(57) ABSTRACT

A disposable, elastic shoe cover for protecting shoes against inclement weather conditions and sharp or abrasive objects. The shoe cover material may be translucent and does not significantly detract from the aesthetic appearance of the shoe. The elasticity of the material allows the shoe cover to hug the shoe to minimize slipping between the shoe and the shoe cover. The shoe cover has a front portion, a rear portion and a sole portion. The shoe cover comes pre-disposed in folded or rolled form and associated packaging which allows for convenient transport or storage of the shoe cover. The shoe cover may be pulled onto a shoe or may be in part unrolled directly onto the shoe.

16 Claims, 4 Drawing Sheets

DISPOSABLE SHOE COVER

TECHNICAL FIELD

The present invention generally relates to shoe protection devices. More specifically, the invention relates to disposable after-market shoe covers designed to be worn for a relatively short period of time and then disposed in any commonly available waste receptacle.

BACKGROUND OF THE INVENTION

Along with the existence of high quality footwear, there exists the need to protect the footwear from harsh elements found outside and in the workplace without compromising the footwear's appearance. Such protection should be convenient to transport and to use, relatively light weight, and non-obtrusive when worn over the shoe; yet the shoe covering should not compromise the appearance of the shoe Currently, shoe covers are used by hospital workers, by heavy-industry workers and by others. For example, hospital workers use special shoe covers to protect sterile operating rooms from outside contaminants; this type of shoe cover provides little protection against elements found outside the hospital such as water, snoW and ice Heavy-industry workers use special shoe covers to protect the shoe surface from heat, damaging chemicals and sharp or abrasive objects in the work environment; this type of shoe cover usually does not cover the shoe completely and is mostly made of heavy and cumbersome materials. Other people use shoe covers, which sometimes are referred to as galoshes or rubbers, or even boots to protect shoes and/or to prevent water leakage through the shoes to the person's feet during inclement weather, such as, in the rain, snow, sleet. etc. Such galoshes, boots or the like are relatively heavy, large and cumbersome in size, bulky to transport if not being worn on the shoe, costly, and sometimes difficult to put on. Usually they are dull black in color and, therefore, are unattractive and, accordingly, completely destroy the aesthetic appearance of the shoe while the galoshes, for example, are worn.

Thus, there is need for a non-obtrusive, adequately durable shoe cover that is convenient to wear and is readily available for use.

BRIEF SUMMARY OF THE INVENTION

Briefly, according to an aspect of the invention, a disposable shoe cover includes a sole and sides of a size and shape to fit in close fitting relation with a shoe, the shoe cover comprising a material that is flexible, elastic, substantially waterproof and which is of a size and shape as to be retained resiliently on a shoe.

According to another aspect, a method of protecting a shoe includes placing on the shoe a disposable shoe cover that is flexible, elastic, substantially waterproof and which is of a size and shape as to be retained resiliently on a shoe.

According to another aspect, a packaged shoe cover includes an elastic material in the shape of at least a portion of a shoe, the shoe cover being rolled as to have a central portion and an annular rolled flange-like portion, and a package containing the rolled shoe cover for storage.

According to another aspect, a shoe cover is translucent or transparent and is made of a material to protect a shoe from inclement weather conditions. The shoe cover does not detract from the aesthetic appearance of the shoe and is conveniently packaged to promote portability when not worn on the shoe. The shoe cover comes disposed in a convenient packaging material and is foldable or rollable for storage in such packaging material for convenient storage in a briefcase, handbag or the like, and the packaging material may be opened relatively easily to remove the shoe cover, which may be applied to a shoe for desired protection thereof. Additionally, the shoe cover may be discarded after use.

To the accomplishment of the foregoing and related ends, the invention, then, comprises the features hereinafter fully described and particularly pointed out in the claims. The following description and the annexed drawings, although not necessarily to scale, set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE OF THE DRAWINGS

DESCRIPTION

Figure 1:
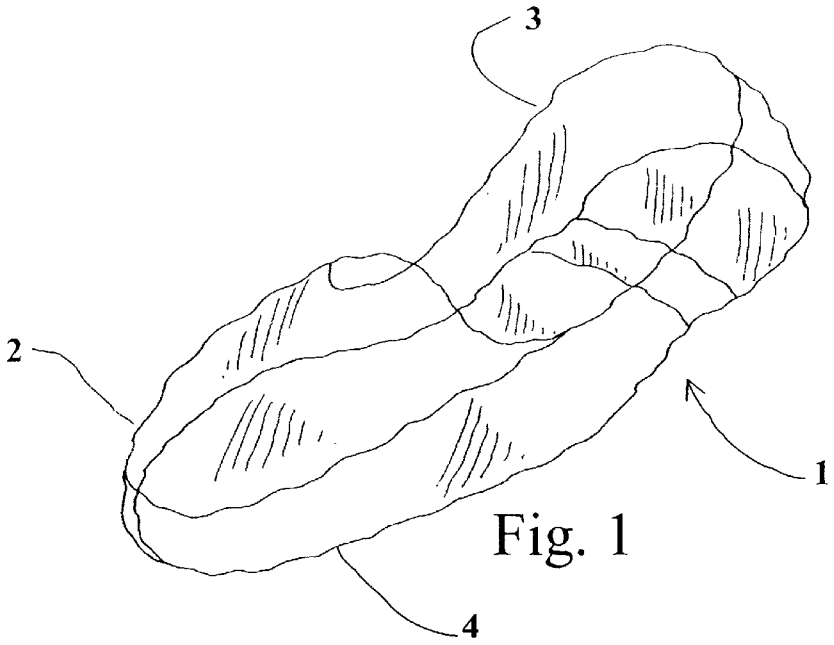
FIG. 1 is a perspective view of a disposable shoe cover in accordance with the invention.

In the detailed following description identical components have been given the same reference numerals in the several figures.

Figure 2:
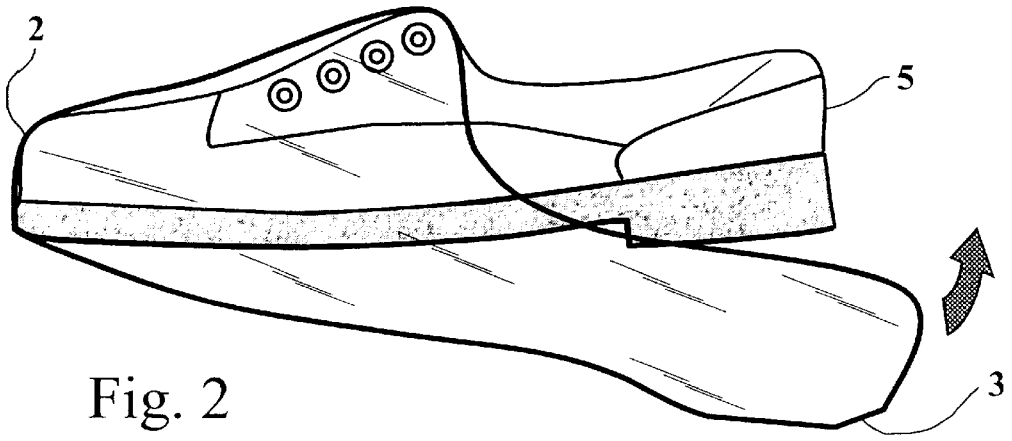
FIG. 2 is a side view of the shoe cover being applied over a shoe.
Figure 3:
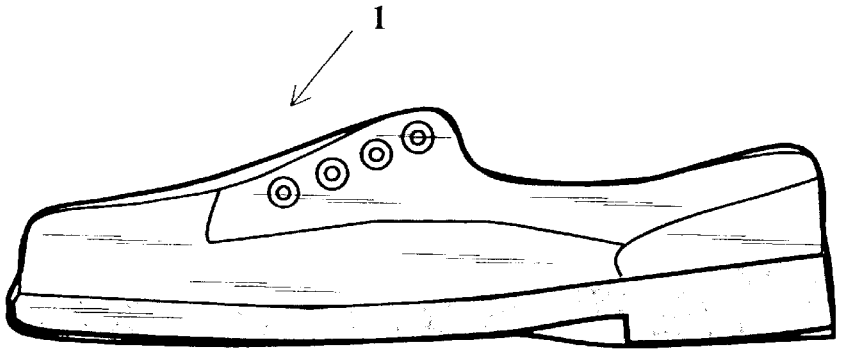
FIG. 3 is a side view of the shoe cover after being applied over a shoe.

Referring to FIGS. 1 through 3, a disposable shoe protector or shoe cover 1 according to the present invention is shown. The illustrated shoe cover 1 has a front portion 2, a rear portion 3 and a sole portion 4. The shoe cover 1 protects shoes, such as shoe 5 shown in FIGS. 2 and 3, from inclement weather conditions but may also offer some protection against sharp objects. The shoe cover 1 is made from an elastic material, which deforms elastically over the surfaces of the shoe on which it is placed. The shoe cover 1 is of a size and shape to hug relatively closely to the shoe. The shape of the shoe cover may be substantially the same as the shape of the shoe on which it is to be placed, able to fit fully to the tops of the sides and top of the shoe; or, if desired, the shoe cover may cover the sole and up only a portion of the sides of the shoe. The shoe cover may fit relatively securely to the shoe and, therefore, the shoe cover will not tend to move or will only move relatively minimally against the shoe as it is worn so it will not degrade the finish of the shoe. Also, the relatively close fitting of the shoe cover to the shoe minimizes slipping between the shoe and the shoe cover 1 and, thus, minimizes any clumsiness or bulkiness feeling while a person wears shoes on which the shoe cover is applied. Still further, the material of which the shoe cover is made may be translucent or clear so that the shoe clearly is seen through the shoe cover material and, thus, the shoe cover is unobtrusive, eg., it may not even be apparent as being worn unless an observer carefully looks at the shoes on which the shoe cover is worn. Accordingly, the shoe cover 1 does not significantly detract from the aesthetic appearance or style of the shoe.

The shoe cover 1 may be made of a suitable material having one or more of the following characteristics: waterproof or substantially waterproof, elastic, transparent or translucent (although if desired the material may be colored), breathable, durable, pliable, resistant to abrasion and/or puncture by sharp objects, and non-allergenic. An advantage of translucent material is that when not in use the translucent material may appear a gray or milky white color; but when the material is applied against a surface the color of the surface tends to show through. The translucent material is less likely to be lost, overlooked, or tripped or stepped on accidentally than an entirely clear or transparent material. However, a clear or transparent material may show through the details of texture or the like from the shoe.

An exemplary material of which the shoe cover 1 may be made is a polyurethane material. An exemplary polyurethane material is that sold under the trademark Estane. Such material is manufactured by The B F Goodrich Company and is obtainable from Deerfield Urethane division of Bayer Pharmaceuticals. Estane is a breathable polyurethane. It is vapor transmissive, allowing transmission of single molecules to "evaporate" therethrough; yet, such material is water resistant, e.g., to resist transmission of water through the material. Estane is abrasion resistant and blunt punch through resistant. It also is alkali and acid resistant; therefore, it will not deteriorate when exposed to various chemicals used to melt snow or ice and/or carried by liquid water. Estane is characterized by a substantial absence of protein, which tends to cause dermatitis as sometimes occurs due to allergic reaction to latex material; and, therefore, Estane is substantially non-allergenic. Moreover, Estane has a very low ion concentration, which avoids electrical transmission and electrical arcing in low humidity environments; and, therefore, Estane material allows the shoe covers 1 thereof to be used in proximity to computers or other electrical and/or electronic equipment without causing sparks, arcing or the like. Further, Estane material is relatively inexpensive, is relatively easy to work with, and does not require as substantial amount to make the shoe covers 1; and, therefore, the shoe covers may be relatively inexpensive, which further enhances the feature of the invention of "throw away" convenience.

Other materials may be used for the shoe covers of the invention.

Another example of a material of which shoe cover of the invention may be made is sold by Teknor Apex Company of Pawtucket, R.I. and Lodi, Ohio, under the name Monprene.

The shoe covers 1 may be thicker at the bottoms compared to the sides and top for increased durability and resistance to puncture. Also, the bottoms may be textured to increase frictional contact with the engaged surface, e.g., the street, sidewalk, floor, ice, snow, etc., thus, reducing the likelihood of slipping on such surface. Alternatively, the material of which the shoe covers are made may have the same thickness (sometimes referred to as gage) at all portions thereof.

Since the shoe covers 1 may be made of a "breathable" material, as was mentioned above, they do not cause heat and/or moisture to accumulate in the shoes being worn and being covered by the shoe covers. Therefore, comfort of the user is enhanced relative to conventional rubber galoshes, boots or the like.

The exemplary Estane material has suitable elastic and pliability characteristics allowing the shoe covers 1 of the invention to hug the shoes, as was mentioned above. The shoe cover may stretch over the shoe on which it is placed, in a sense to form fit the shoe. Indeed, such fit to the shoes may be analogous to the fit of surgical gloves to the hand of a wearer.

Referring to FIGS. 2 and 3, the wearer first applies the front portion 2 of the shoe cover 1 over the front of the shoe 5. The elastic material allows the shoe cover 1 to elastically deform around the surfaces of the shoe so that the rear portion 3 is stretched over the rear of the shoe as shown in FIG. 2. FIG. 3 shows the shoe cover 1 after being applied over the shoe. The shoe cover may be applied over most shoes such that the rear portion 3 covers enough of the rear of the shoe so it relatively tightly elastically and resiliently holds to the shoe with minimal slippage between the shoe cover 1 and the shoe. Therefore, the shoe cover 1 ordinarily will not unintentionally come off the shoe. After use, the shoe cover 1 may be conveniently removed from the shoe and disposed of in a waste receptacle.

Figure 4:
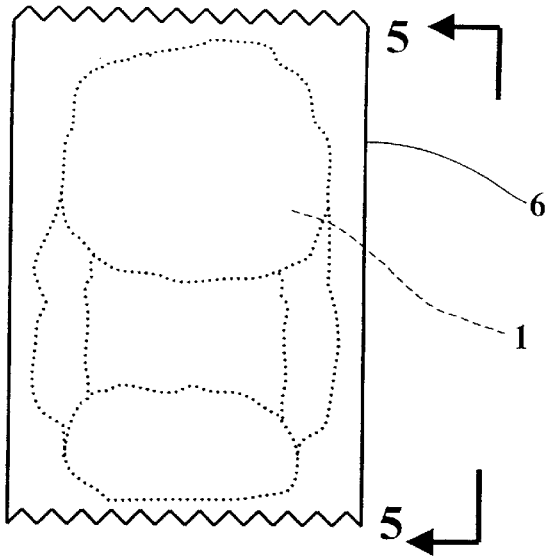
FIG. 4 is a top plan view of the shoe cover folded and disposed inside shoe cover packaging.
Figure 5:
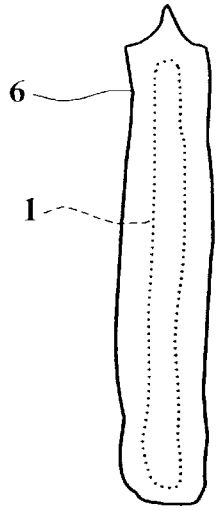
FIG. 5 is a side elevation view of the shoe cover and packaging looking in the direction of the arrows 4—4 of FIG. 4.

Referring to FIGS. 4 and 5, one embodiment of packaging 6 for the shoe cover 1 is shown. Here the shoe cover is folded and is conveniently pre-disposed in packaging 6. The folding is readily possible due to the relatively thin, pliable, flexible, resilient and elastic characteristics of the material of which the shoe cover 1 is made. As is illustrated, the folded shoe cover may be relatively flat, which facilitates containment in the packaging with a rather thin thickness or profile of the packaging. Although the packaging 6 is illustrated with a single shoe cover 1 therein, it will be appreciated that if desired there may be two shoe covers contained in the packaging.

The packaging 6 with the shoe cover(s) 1 therein is small and relatively flat, which facilitates storage in a briefcase or small handbag, for example. The packaging 6 may be made of a foil type material or a foil lined material, such as that in which alcohol wipes, liquid-containing baby wiping tissues or other devices are stored prior to use. The packaging may be made of other suitable material, such as paper, plastic, combinations thereof, etc. The packaging may be shrink wrapped, heat sealed and/or vacuum sealed to contain one or more shoe covers therein. The shoe cover is relatively thin and flexible and easily can fold flat, as is illustrated in FIGS. 4 and 5, which facilitates such packaging.

Figure 6:
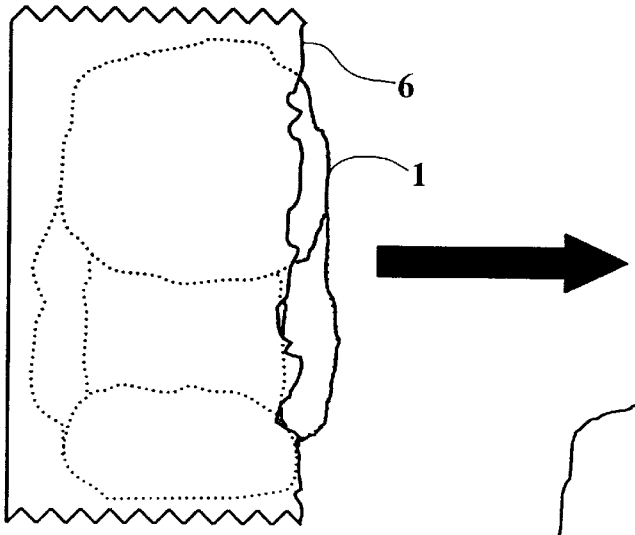
FIG. 6 is a top plan view of the folded shoe cover prior to being taken out of the shoe cover packaging with a section of the packaging torn away.
Figure 7:
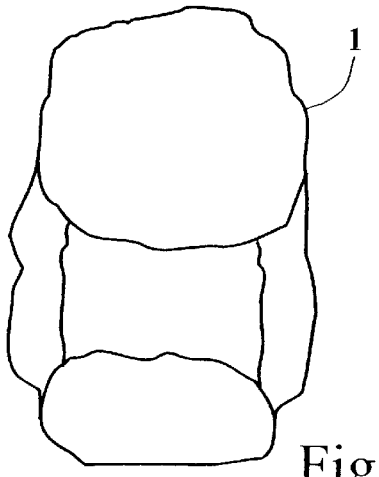
FIG. 7 is a top plan view of the folded shoe cover.

When a wearers shoes need protection, the wearer takes the packaged shoe cover out of storage and, referring to FIG. 6, tears open the packaging 6. The wearer then takes the folded shoe cover 1 out of the packaging 6. FIG. 7 shows the folded shoe cover 1 after being taken out of the packaging 6. The wearer then unfolds the shoe cover 1, as is illustrated in FIG. 1, and the shoe cover can be slipped onto the shoe 5, as was described above. After use, the shoe covers 1 can be removed from the shoes on which placed and can be discarded. Since the shoe covers may be discarded, there is no need to store them or to clean them for future use.

Figure 8:
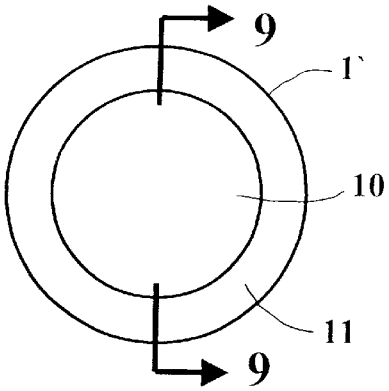
FIG. 8 is a plan view of another embodiment of shoe cover shown in a rolled up storage condition.
Figure 10:
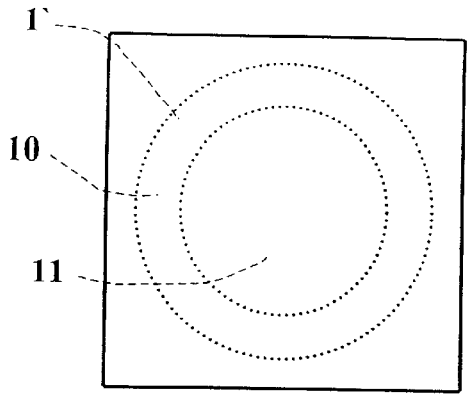
FIG. 10 is a plan view of the shoe cover of FIGS. 8 and 9 contained disposed in shoe cover packaging.
Figure 9:
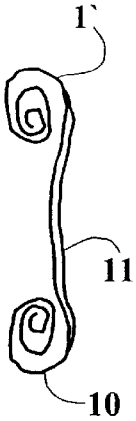
FIG. 9 is a side elevation view of the rolled up shoe cover of FIG. 8.

Turning, now, to FIGS. 8–12 another embodiment of shoe cover 1' is illustrated with respect to the shoe cover itself, the packaging for it and the method of using it. The shoe cover 1' has a shape, when used on a shoe 5 similar to the shoe cover 1 described above. However, the shoe cover 1' can be rolled to a storage condition that is schematically shown in FIGS. 8–10. Such rolled storage condition is similar to the typical rolled storage condition for a conventional prophylactic device. Thus, the shoe cover 1' has a central portion 10 and an annular rolled portion 11. The shoe cover 1' can be stored in a package 6, which is similar to the package described above in that it may be a foil or other material containing the shoe cover in its rolled storage condition; and the package can be torn open and the shoe cover removed.

Figure 11:
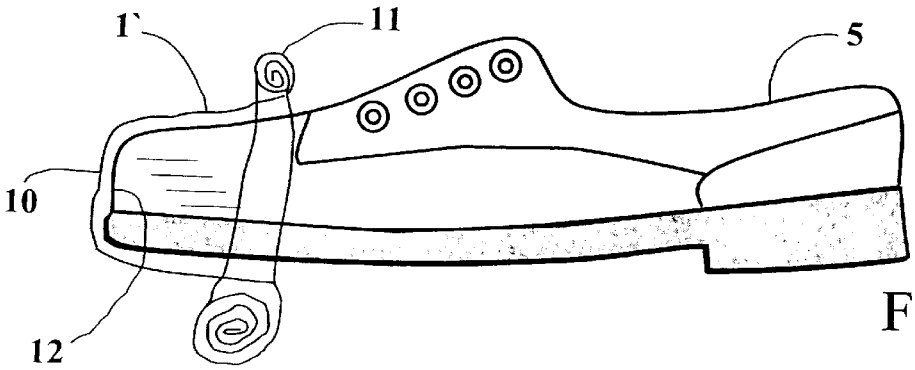
FIGS. 11 and 12 are schematic illustrations of the shoe cover of FIGS. 8–10 being unrolled as it is applied to a shoe.
Figure 12:
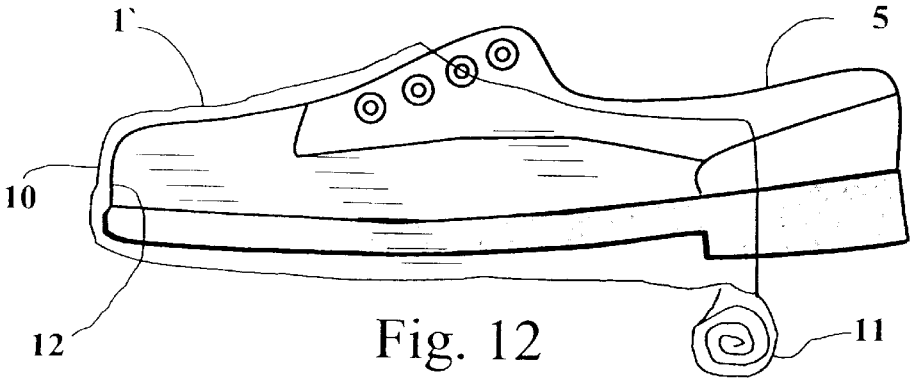

In FIGS. 11 and 12 the method of applying the shoe cover 1' to a shoe 5 is illustrated. The rolled shoe cover 1' is removed from the package 6 and a central portion 10 is placed against the front 12 of the shoe 5. The annular rolled portion 11 of the shoe cover 1' then can be unrolled as the material of which the shoe cover is made stretches and fits closely to the outside of the shoe 5 until the rolled portion is unrolled and the entire shoe cover is placed on the shoe. The method of placing the shoe cover during such unrolling may include unrolling the rolled annular portion along surfaces of the shoe while the material of which the shoe cover is made tends to engage against the shoe surface.

Figure 13:
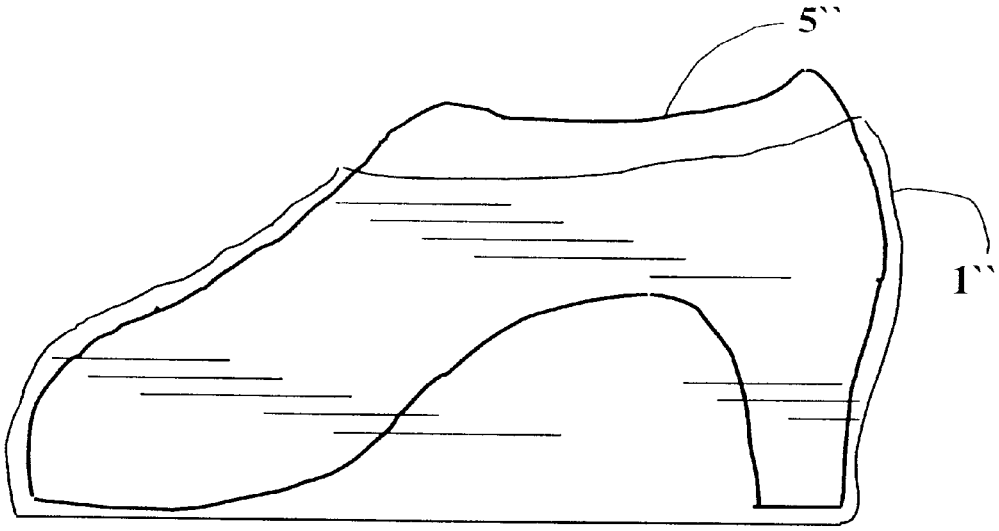
FIG. 13 is a schematic illustration of a shoe cover of the invention in place on a relatively high heel shoe.

Briefly referring to FIG. 13, a shoe cover 1" is shown positioned on a relatively high heel shoe 5". Thus, it will be appreciated that the shape of the shoe cover of the invention may be configured to fit any of a number of particular styles and/or sizes of shoes. As the material of which the shoe cover is made is somewhat resilient or elastic, one shape shoe cover may fit several styles and sizes of shoes. Also, the shoe cover may be provided in several sizes and shapes to fit different respective groups of shoe sizes and/or shapes, e.g., typical children's shoes, men's shoes, ladies'shoes, etc.

Industrial Application

It will be appreciated that the shoe covers of the invention may be conveniently stored and may be used to protect shoes or other footwear.

What is claimed is:

1. A disposable shoe cover, comprising:

a sole, a front portion, and a rear portion, configured to fit in close fitting relation with a shoe, wherein the shoe cover includes a material that is flexible, elastic, substantially waterproof said material being polyurethane, and wherein the shoe cover is translucent.

2. The shoe cover according to claim 1, wherein the shoe cover has a shape to fit a relatively high heel shoe.

3. The shoe cover of claim 1, wherein the shoe cover is in a rolled shape.

4. The shoe cover of claim 3, wherein the rolled shape has a central portion and an annular rolled portion.

5. A disposable shoe cover, comprising:

a sole, a front portion, and a rear portion, configured to fit in close fitting relation with a shoe, wherein the shoe cover includes a material that is flexible, elastic, substantially waterproof, said material being polyurethane, wherein said polyurethane is a breathable polyurethane, and wherein the front portion and the mar portion each include a translucent material.

6. The shoe cover according to claim 5, wherein said sole portion is of a thickness substantially equal to the thickness of the other portions of said shoe cover.

7. The shoe cover according to claim 5, wherein said sole portion is of a greater thickness than the other portions of said shoe cover.

8. A disposable shoe cover system, comprising:

a shoe cover package; and a shoe cover in the package;

wherein the shoe cover includes a sole portion, a front portion, and a rear portion;

wherein the portions configured to fit in close fitting relation with a shoe;

wherein the shoe cover is made of a flexible, elastic polyurethane; and wherein the polyurethane is translucent.

9. The system of claim 8, wherein the polyurethane is a breathable polyurethane that is vapor transmissive.

10. The system of claim 8, wherein the shoe cover package is a shrink-wrapped package.

11. The system of claim 8, wherein the shoe cover package is a vacuum-sealed package.

12. The system of claim 8, wherein the shoe cover package is a thermal-sealed package.

13. The system of claim 8, wherein the shoe cover package is a foil-lined package.

14. The system of claim 8, wherein the shoe cover is folded in a substantially flat shape along unscored parts of the shoe cover.

15. The system of claim 14, wherein the shoe cover is maintained, under its own weight, folded in the substantially flat shape.

16. The system of claim 15, wherein the polyurethane is a breathable polyurethane that is vapor transmissive.

* * * * *